US007005224B2

(12) United States Patent
Hohner et al.

(10) Patent No.: US 7,005,224 B2
(45) Date of Patent: Feb. 28, 2006

(54) POLYOLEFIN WAXES MODIFIED TO MAKE THEM POLAR IN PHOTOCOPIER TONERS

(75) Inventors: Gerd Hohner, Gersthofen (DE); Michael Bayer, Thierhaupten (DE)

(73) Assignee: Clariant GmbH, Frankfurt (DE)

( * ) Notice: Subject to any disclaimer, the term of this patent is extended or adjusted under 35 U.S.C. 154(b) by 37 days.

(21) Appl. No.: 10/303,279

(22) Filed: Nov. 25, 2002

(65) Prior Publication Data

US 2003/0108807 A1 Jun. 12, 2003

(30) Foreign Application Priority Data

Dec. 6, 2001 (DE) ..... 101 59 955

(51) Int. Cl.
*G03G 9/08* (2006.01)

(52) U.S. Cl. ..... 430/108.4; 430/108.8; 430/137.1; 430/137.11

(58) Field of Classification Search ..... 430/108.1, 430/108.4, 108.8, 137.11, 137.1
See application file for complete search history.

(56) References Cited

U.S. PATENT DOCUMENTS

| | | | | |
|---|---|---|---|---|
| 3,425,384 A | | 2/1969 | Bell | |
| 4,535,049 A | | 8/1985 | Honda et al. | |
| 4,973,540 A | * | 11/1990 | Machida et al. | 430/108.11 |
| 5,023,388 A | | 6/1991 | Luker | 585/9 |
| 5,081,322 A | | 1/1992 | Winter et al. | 528/9 |
| 5,116,713 A | * | 5/1992 | Uchida et al. | 430/108.8 |
| 5,330,568 A | | 7/1994 | Park et al. | 160/270 |
| 5,466,555 A | * | 11/1995 | Taguchi et al. | 430/108.4 |
| 5,658,999 A | * | 8/1997 | Inoue et al. | 526/351 |
| 5,707,772 A | | 1/1998 | Akimoto et al. | |
| 5,733,692 A | * | 3/1998 | Nagase et al. | 430/45 |
| 5,853,940 A | * | 12/1998 | Kido et al. | 430/108.4 |
| 5,928,825 A | * | 7/1999 | Eguchi et al. | 430/108.4 |
| 5,972,553 A | * | 10/1999 | Katada et al. | 430/108.23 |
| 5,998,547 A | | 12/1999 | Hohner | 525/301 |
| 6,080,902 A | | 6/2000 | Herrmann et al. | 585/512 |
| 6,107,530 A | | 8/2000 | Hohner et al. | 585/9 |
| 6,133,490 A | | 10/2000 | Toyoda et al. | 585/9 |
| 6,210,852 B1 | * | 4/2001 | Nakamura | 430/108.2 |
| 6,211,303 B1 | | 4/2001 | Hohner | 525/388 |
| 6,348,547 B1 | | 2/2002 | Deckers et al. | 525/333.8 |
| 6,384,148 B1 | | 5/2002 | Herrmann et al. | 525/333.8 |
| 6,812,274 B1 | | 11/2004 | Deckers et al. | 524/487 |
| 2004/0059046 A1 | * | 3/2004 | Hanna et al. | 524/515 |

FOREIGN PATENT DOCUMENTS

| | | | |
|---|---|---|---|
| DE | 196 17 230 | | 11/1997 |
| DE | 196 48 895 | | 5/1998 |
| DE | 198 10 890 | | 1/1999 |
| EP | 0 321 581 | | 6/1989 |
| EP | 0 772 093 | | 5/1993 |
| EP | 0 571 882 | | 12/1993 |
| EP | 0 632 063 | | 1/1995 |
| EP | 0 843 222 | | 5/1998 |
| EP | 0 890 882 | | 1/1999 |
| EP | 902045 | | 3/1999 |
| EP | 0 941 257 | | 9/1999 |
| EP | 0 961 175 | | 12/1999 |
| EP | 0978766 | A1 * | 2/2000 |
| EP | 1 013 672 | | 6/2000 |
| WO | WO02/060965 | A2 * | 8/2002 |

OTHER PUBLICATIONS

*Plastic Technology—Online*, "MPP Wax Aids Dispersion of Pigment Concentrates," Sep. 2002.*
English abstract for EP 0571882, Dec. 1, 1993 from ESP@CENET.
USPTO Office Action for 10/220,076, mailed Jul. 15, 2004.
USPTO Office Action for 10/220,076, mailed Dec. 3, 2004.
USPTO Office Action for 10/239,605, mailed Sep. 1, 2004.
USPTO Office Action for 10/239,605, mailed Jun. 28, 2005.
USPTO Office Action for 10/220,077, mailed Jun. 17, 2005.
USPTO Office Action for 10/220,077, mailed Oct. 6, 2004.
USPTO Office Action for 10/220,077, mailed Mar. 18, 2004.
USBPAI Decision on Appeal Appeal No 2001-2479, U.S. Appl. No. 09/113,834, Mailed Mar. 13, 2003.
USPTP Reply Brief for U.S. Appl. No. 09/113,834, mailed Feb. 2, 2001.
USPTO Office Action for U.S. Appl. No. 09/113,834, mailed May 31, 2000.

* cited by examiner

*Primary Examiner*—Janis L. Dote
(74) *Attorney, Agent, or Firm*—Anthony A. Bisulca

(57) ABSTRACT

The present invention relates to the use of polyolefin waxes which have been prepared by means of metallocene catalysts and have been modified to make them polar in photocopier toners and also to photocopier toners comprising such polyolefin waxes modified to make them polar.

3 Claims, No Drawings

POLYOLEFIN WAXES MODIFIED TO MAKE THEM POLAR IN PHOTOCOPIER TONERS

The present invention relates to the use of polyolefin waxes which have been prepared by means of metallocene catalysts and have been modified to make them polar in photocopier toners and also to photocopier toners comprising such polyolefin waxes modified to make them polar.

In modern copying processes, use is usually made of photocopier toners which comprise resins, pigments, loading control agents and waxes together with, if appropriate, flow aids. In the copying process, the pulverulent photocopier toners usually firstly form the image to be copied on a transfer roller, are from there transferred to the copying paper and are subsequently thermally fixed.

The waxes present in the toner as formulation components act as release and anti-offset agent so as to aid the detachment of the photocopier toner from the fixing roller, act as adhesion promoters in the transfer to the paper and, in the production of the toner, contribute to homogeneous distribution of the pigments by acting as dispersion aid.

Modern copiers can produce more than 40 copies/minute, corresponding to a transport velocity of more than 0.2 m/s, by this method.

The demand for ever faster copiers accordingly requires fast-reacting toner systems and places severe demands on the individual components of the toner formulation.

U.S. Pat. No. 5,707,772 describes the use of an anti-offset agent based on nonpolar polyolefins prepared using metallocene catalysts.

EP-0 843 222 A1 describes the use of release agents based on nonpolar olefin homopolymer and copolymer waxes which have likewise been prepared with the aid of metallocene catalysts.

EP-0 890 882 A1 describes the use of nonpolar propylene homopolymer and copolymer waxes prepared by means of metallocenes in photocopier toners.

The waxes mentioned do not meet the requirements of modern fast-running copying machines in all aspects. In particular, there is a need for wax components having improved anti-offset action, an improved action in respect of adhesion of the print on the paper and further optimized pigment-dispersing properties.

Oxidized waxes (DE-A-196 17 230) obtainable from polyolefins prepared by means of metallocene catalysts are also known.

In DE-A-198 10 890, the polar modification of polyethylene waxes prepared using metallocene catalysts by oxidation with oxygen or oxygen-containing gases in the melt is described.

EP-A-1 013 672 describes the preparation of waxes modified to make them polar by oxidation of relatively high molecular weight polyethylene prepared using metallocene catalysts.

DE-A-196 48 895 discloses polypropylene waxes which have been modified to make them polar and have been prepared from polypropylene waxes obtained with the aid of catalysts of the Ziegler or metallocene type. These are modified by reaction with α,β-unsaturated carboxylic acids or their derivatives. As possible uses, mention is made of use in aqueous dispersions, melt adhesive formulations and as additives for plastics.

It has now surprisingly been found that polar waxes whose nonpolar precursors have been prepared with the aid of metallocene catalysts are particularly advantageous as additives for photocopier toners. In particular, more homogeneous dispersion of the pigment in the production of the toner and an improved anti-offset action and increased adhesion of the print on the paper in the fixing process are achieved by means of such waxes.

The invention accordingly provides for the use of polyolefin waxes which have been prepared by means of metallocene catalysts and have been modified to make them polar in photocopier toners.

The invention also provides for the use of polyolefin waxes modified to make them polar in photocopier toners, in the case of which the polar modification is carried out on nonpolar polyolefin waxes prepared using metallocene catalysts and is carried out a) by oxidation by means of oxygen or oxygen-containing gases and, if desired, converting the oxidation products into derivatives and/or b) by reaction with α,β-unsaturated carboxylic acids, esters or anhydrides and, if desired, conversion of the reaction products into derivatives and/or c) by reaction with styrene.

As polyolefin waxes to be modified to make them polar, preference is given to using homopolymers of linear or branched α-olefins having from 2 to 30 carbon atoms or copolymers of these olefins among one another.

The polyolefin waxes which have been modified to make them polar preferably have melt viscosities measured at 170° C. of from 5 to 10 000 mPa.s, saponification numbers of from 0.1 to 100 mg KOH/g and softening points in the range from 80 to 160° C.

The invention further provides photocopier toners comprising at least one pigment component, a resin component and a polyolefin wax which has been prepared by means of a metallocene catalyst and has been modified to make it polar.

As base component, photocopier toners generally comprise resins based on polyesters or styrene-acrylate copolymers. As loading control agents, which aid the transfer of the toner from the photocopier roller to the paper substrate, use is made of, for example, quaternary ammonium salts for a positive charge and aluminum-azo complexes for a negative charge of the toner powder. To aid powder flow, small amounts of finely divided silicas can be added to the toner powder.

Depending on the desired color, suitable black or colored pigments are added to the toners at the stage of the thermoplastic mixture.

In the following, the term "polyolefin waxes" refers to low molecular weight polymers of linear or branched α-olefins having from 2 to 30 carbon atoms prepared by means of metallocene catalysts. They include both homopolymers of the olefins mentioned and copolymers of these olefins among one another in any ratios.

Metallocene catalysts for preparing polyolefin waxes are chiral or nonchiral transition metal compounds of the formula $M^1L_x$. The transition metal compound $M^1L_x$ contains at least one central metal atom $M^1$ to which the π ligand or ligands, e.g. a cyclopentadienyl ligand, is/are bound. In addition, substituents such as halogen atoms or alkyl, alkoxy or aryl groups may be bound to the central metal atom $M^1$. $M^1$ is preferably an element of main group III, IV, V or VI of the Periodic Table of the Elements, e.g. Ti, Zr or Hf. For the purposes of the present invention, the term cyclopentadienyl ligand encompasses unsubstituted cyclopentadienyl radicals and substituted cyclopentadienyl radicals such as methylcyclopentadienyl, indenyl, 2-methylindenyl, 2-methyl-4-phenylindenyl, tetrahydroindenyl or octahydrofluorenyl radicals. The π ligands can be bridged or unbridged, with both single and multiple bridges, including bridges via ring systems, being possible. The term metallocene also encompasses compounds having more than one metallocene fragment, known as multinuclear metallocenes. These can have any substitution pattern and bridging variants. The individual metallocene fragments of such multinuclear metallocenes can be identical or different. Examples of such multinuclear metallocenes are described, for example, in EP-0 632 063 A1.

Examples of structural formulae of metallocenes and of their use for preparing olefin homopolymer and copolymer waxes are given in, for example, EP-0 571 882 A1.

The polyolefin waxes before being modified to make them polar have melt viscosities measured at 170° C. in the range from 5 to 10 000 mPa.s and softening points in the range from 85 to 165° C.

These polyolefin waxes can be modified to make them polar by oxidation by means of oxygen or oxygen-containing gases below or above the melting point. The wax is preferably oxidized in the molten state at temperatures from the melting point of the wax to 200° C. by passing oxygen or oxygen-containing gases, preferably air, into it. The waxes modified by oxidation have acid numbers of from 0.1 to 100 mg KOH/g, preferably from 1 to 30 mg KOH/g, melt viscosities measured at 170° C. of from 5 to 10 000 mPa.s, preferably from 20 to 5 000 mPa.s, and softening points of from 80 to 160° C. Such waxes also include derivatives of the oxidation products obtained in this way, as can be prepared, for example, by esterification with monohydric or polyhydric, aliphatic or aromatic alcohols, e.g. ethanol, propanol, butanols, ethanediol, butanediols, glycerol, trimethylolpropane, pentaerythritol or benzyl alcohol. In the case of partial esters, these can be converted into further derivatives by, for example, esterification with acid components such as acrylic acid or methacrylic acid.

A further possible way of modifying the waxes to make them polar is reaction of the polyolefin wax with α,β-unsaturated carboxylic acids or their derivatives, if appropriate in the presence of a free-radical initiator. Examples of α,β-unsaturated carboxylic acids are acrylic acid, methacrylic acid, crotonic acid and maleic acid. Examples of derivatives of a, β-unsaturated carboxylic acids are their esters or amides or anhydrides, e.g. alkyl acrylates, acrylamides, monoesters or diesters of maleic acid, maleic anhydride or amides of maleic acid, e.g. maleimide or N-alkyl-substituted maleimides. It is also possible to use mixtures of these compounds. Preference is given to maleic acid and its derivatives; particular preference is given to maleic anhydride. The α,β-unsaturated carboxylic acids or their derivatives are used in an amount of 0.1–20% by weight, based on polyolefin wax used. The preparation of such free-radically produced polar reaction products is described, for example, in EP-0 941 257 A1. The polar polyolefin waxes obtained by reaction of polyolefin waxes with α,β-unsaturated carboxylic acids and their derivatives have melt viscosities measured at 170° C. of from 5 to 10 000 mPa.s, preferably from 10 to 5 000 mPa.s, saponification numbers of from 0.1 to 100 mg KOH/g, preferably from 2 to 80 mg KOH/g, and softening points of from 80 to 160° C., preferably from 100 to 155° C.

The invention also provides for the use of wax products which have been prepared by free-radical reaction of polyolefin waxes with styrene in an amount of 0.1–30% by weight, based on the polyolefin wax used.

It is also possible to combine the abovementioned modification methods, for instance by firstly reacting the polyolefin wax with α,β-unsaturated carboxylic acids or their derivatives and subsequently oxidizing the reaction product.

EXAMPLES

The melt viscosities of the wax products described below were measured in accordance with DIN 51562 using a rotation viscometer. The saponification numbers were determined in accordance with the DIN standard 53401, and the softening points and flow hardnesses (indenter penetrations) were determined in accordance with the "standard methods" M-IV 2 (75) or M-III 13 (75) of the Deutsche Gesellschaft für Fettchemie (German Society for Fat Chemistry).

For the modification, the following polyolefin waxes prepared using metallocene catalysts in a method based on the examples of EP 321 851 and EP 571 882 were employed:

| | Type | Viscosity/ 170° C. mPa.s | Softening point R/B (° C.) | Flow hardness bar |
|---|---|---|---|---|
| Polyolefin wax 1 | Ethylene homopolymer | 50 | 123 | 530 |
| Polyolefin wax 2 | Propylene homopolymer | 30 | 136 | 880 |
| Polyolefin wax 3 | Propylene homopolymer | 2800 | 140 | 900 |

Modification by Oxidation

A mixture comprising 700 g of polyolefin wax 1 was melted in a 2 l four-neck flask equipped with thermometer, high-speed propeller stirrer and an immersed tube as gas inlet. After an internal temperature of 140° C. had been reached, the stirrer was run at 4 000 revolutions per minute and an air stream of 200 l/h was passed into the wax melt. The reaction temperature rose to a maximum of 165° C. Samples for determination of the viscosity were taken at intervals of 2 hours. The reaction was stopped after 6 hours. The product formed (modified wax 1) had a saponification number of 30 mg KOH/g, a viscosity of 20 mPa.s at 170° C., a softening point (ring/ball) of 118° C. and a flow hardness of 380 bar.

Modification by Reaction with Maleic Anhydride 500 g of polyolefin wax 2 were melted under a blanket of nitrogen in a glass apparatus equipped with stirrer, internal thermometer and distillation attachment. At a temperature of 165° C., 26.7 g of liquid maleic anhydride which had been heated to about 60° C. was introduced continuously from a metering funnel over a period of three hours; at the same time, 10.5 g of di-tert-butyl peroxide was added continuously from a second dropping funnel. When the additions were complete, a further 1.1 g of di-tert-butyl peroxide were added to the reaction mixture, the reaction temperature was increased to 170° C. and the mixture was allowed to react further for 2 hours. A vacuum of about 30 mbar was subsequently applied and the volatile components were distilled off. After about 30 minutes, the pressure was brought to atmospheric pressure by admission of nitrogen. To separate off remaining volatile constituents, nitrogen was passed through the wax melt for another 15 minutes and the melt was poured out. This gave a light-yellow wax (modified wax 2) having a saponification number of 58 mg KOH/g, a melt viscosity at 170° C. of 20 mPa.s, a ring/ball softening point of 134° C. and a flow hardness of 900 bar.

In the same way, polyolefin wax 3 was modified with maleic anhydride to make it polar. This gave a light-yellow wax (modified wax 3) having a saponification number of 60 mg KOH/g, a melt viscosity at 170° C. of 2 100 mPa.s, a ring/ball softening point of 138° C. and a flow hardness of 1 000 bar.

The following examples demonstrate the incorporation of the waxes according to the invention into toners as are used in photocopiers and digital printing machines:

Example 1

90 parts by weight of a styrene-acrylate resin (type CPR 100, manufactured by Mitsui; glass transition temperature=60° C.; MFR/140° C.=5 g/10 min) were homogeneously mixed with 4 parts by weight of a black pigment (carbon black having a mean particle size of 2 μm; manufactured by: Timcal), 1.0 part by weight of a loading control agent (Copy Charge N4S, manufactured by: Clariant GmbH) and 4 parts by weight of the modified wax 1 according to the invention at 150° C. in a kneader. This mixture was then comminuted to give a toner powder having a mean particle size of 12 μm (100%<20 μm). 0.5 part by weight of a silica-based flow aid (type HDK, manufactured by: Wacker) was then added to the tone powder. 5 g of this now free-flowing mixture were mixed with 95 g of iron powder and placed in the reservoir of a copier.

Toner powder was then applied to a sheet of paper over an area of 20×100 mm by means of the photomagnetic roller in the copier. This image was then fixed at 160° C. and a linear velocity of 150 mm/s by means of a roller arrangement consisting of a rigid heatable roller and an elastic cold roller. A further white sheet was subsequently passed through the hot pair of rollers and examined for toner residues. No "ghost pictures" could be seen on the white sheet.

Example 2

1 g of the toner powder from Example 1 was stirred with 2 g of ethanol and applied by means of a doctor blade to a paper substrate (layer thickness: 40 μm). After the solvent had been dried off at 40° C., the remaining powder layer was fixed at 140° C. and a linear velocity of 120 mm/s. The fixed toner layer was examined by means of an abrasion test on a testing apparatus as used in the testing of printing inks. 50 strokes of rubbing paper against toner gave no measurable abrasion. Folding the toner layer about 180° resulted in no visible fold lines or flaking.

Example 3

In place of the modified wax 1 mentioned in Example 1, the modified waxes 2 and 3 were used here. The proportion of pigment was at the same time reduced by 25%. Otherwise the procedure was as in Example 1. The prints had the same depth of color as a standard without wax tested in parallel as described in Example 1. This indicates that more effective pigment dispersion is achieved by means of the addition of wax.

The invention claimed is:

1. A method for making a photocopier toner comprising the steps of polar modifying a nonpolar ethylene homopolymer wax prepared using a metallocene catalyst to form a polar ethylene homopolymer wax and adding said polar ethylene homopolymer wax to the photocopier toner, wherein said polar modifying step further comprises reacting said nonpolar ethylene homopolymer wax prepared using a metallocene catalyst with maleic anhydride, wherein the polar ethylene homopolymer wax has a melt viscosity measured at 170° C. of from 5 to 10 000 mPa.s, a saponification number of from 0.1 to 100 mg KOH/g and a softening point of from 80 to 160° C.

2. A photocopier toner made in accordance with the method of claim 1.

3. A photocopier toner comprising at least one resin, at least one pigment, and at least one polar modified ethylene homopolymer wax prepared in accordance with the method of claim 1.

* * * * *